US005353955A

United States Patent [19]

Kaufman et al.

[11] Patent Number: 5,353,955

[45] Date of Patent: Oct. 11, 1994

[54] BEVERAGE CONTAINER

[75] Inventors: Richard H. Kaufman, Chappaqua; Theodore J. Kovacic, Bedford, both of N.Y.; Hideyoshi Okita, Huntington Beach, Calif.; Martin M. Bostwick, Norwalk, Conn.; Andrew T. Kostanecki, Darien, Conn.; Robert H. Brainard, Danbury, Conn.; Patrick B. Nolan, Norwalk, Conn.

[73] Assignee: Kraft General Foods, Inc., Northfield, Ill.

[21] Appl. No.: 958,396

[22] Filed: Oct. 8, 1992

Related U.S. Application Data

[63] Continuation-in-part of Ser. No. 958,670, Oct. 8, 1992, Pat. No. 5,280,844, and a continuation-in-part of Ser. No. 958,408, Oct. 8, 1992, and a continuation-in-part of Ser. No. 898,114, Jun. 12, 1992, which is a continuation-in-part of Ser. No. 776,444, Oct. 17, 1991, abandoned.

[51] Int. Cl.[5] ..... B65D 25/00

[52] U.S. Cl. ..... 220/710; 206/217; 206/229; 215/1 A; 215/229

[58] Field of Search ..... 220/710; 206/229, 217; 215/1 A, 229

[56] References Cited

U.S. PATENT DOCUMENTS

| | | | |
|---|---|---|---|
| 2,516,728 | 7/1950 | Smith | 222/108 |
| 3,303,984 | 2/1967 | Jurena | 229/7 |
| 3,332,567 | 7/1967 | Pugh, Sr. | 215/100 |
| 3,347,401 | 10/1967 | Nataf | 215/1 |
| 3,462,061 | 8/1969 | Shore | 229/7 |
| 3,486,679 | 12/1969 | Pfahler | 229/7 |
| 4,301,926 | 11/1981 | Chung | 206/620 |
| 4,573,631 | 3/1986 | Reeves | 229/7 |
| 4,607,755 | 8/1986 | Andreozzi | 215/1 A |
| 4,669,608 | 6/1987 | Thompson | 206/217 |
| 4,712,702 | 12/1987 | Ayabe et al. | 220/90.2 |
| 4,830,204 | 5/1989 | Lin | 215/1 A |
| 4,982,854 | 1/1991 | Ichimiya | 215/1 A |
| 5,005,717 | 4/1991 | Oilar | 215/13.1 |
| 5,054,631 | 10/1991 | Robbins, III | 215/1 A |
| 5,078,286 | 1/1992 | Hashimoto | 215/1 A |

FOREIGN PATENT DOCUMENTS

| | | | |
|---|---|---|---|
| 2492769 | 4/1982 | France . | |
| 59-172168 | 11/1984 | Japan . | |
| 61-681553 | 6/1986 | Japan . | |
| 63-79337 | 5/1988 | Japan . | |
| 2-117334 | 9/1990 | Japan . | |
| 978901 | 1/1965 | United Kingdom | 229/130.1 |
| WO8504850 | of 1985 | World Int. Prop. O. . | |

*Primary Examiner*—Joseph Man-Fu Moy
*Attorney, Agent, or Firm*—Thomas R. Savoie

[57] ABSTRACT

Unitary beverage containers include a main body defining a container volume. A flexible conduit or straw is fluidly connected at a proximal end with the volume adjacent the bottom or top of the main body. The conduit or straw also includes a distal end which is preferably in the form of some shape of hollow mouthpiece having a central aperture therein with the mouthpiece is located adjacent the top of the main body. A connection or closing mechanism removably attaches a hollow member to the distal end of the flexible straw or conduit and closes the aperture of the distal end. The mechanism includes a short hollow bridge extending from the aperture at the distal end of the flexible straw or conduit which is broken during removal of the hollow member to uncover the aperture prior to use. The hollow member is otherwise isolated fluidly from the container volume. A indentation in which the mouthpiece and hollow member are received is provided at the top. A second attaching mechanism in some embodiments removably attaches the flexible straw or conduit to the main body.

33 Claims, 7 Drawing Sheets

Fig. 4
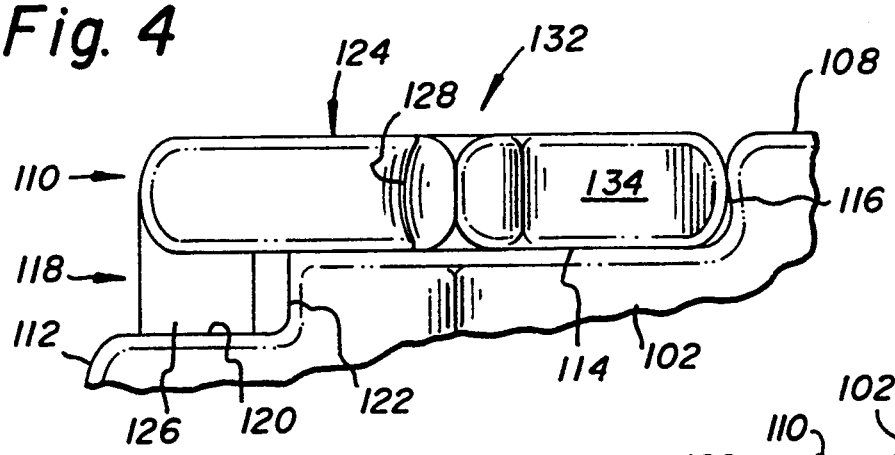
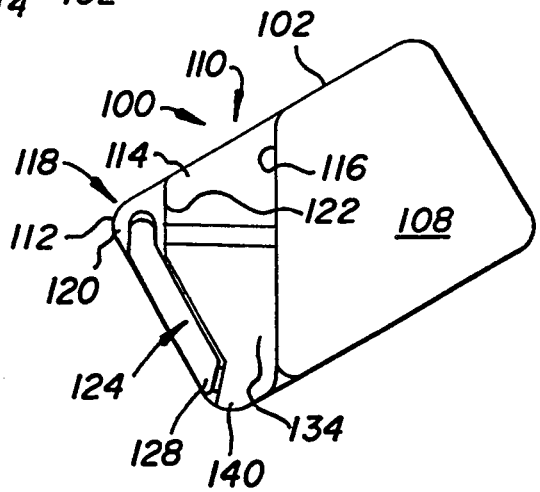
Fig. 3
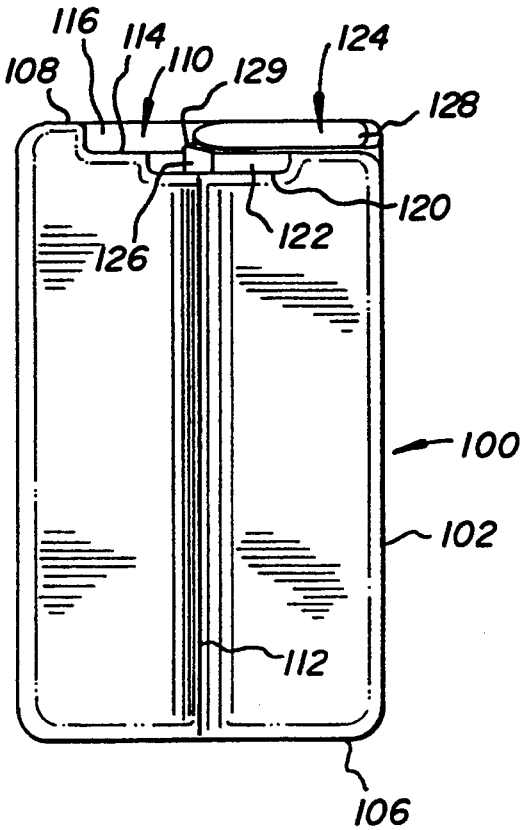
Fig. 2
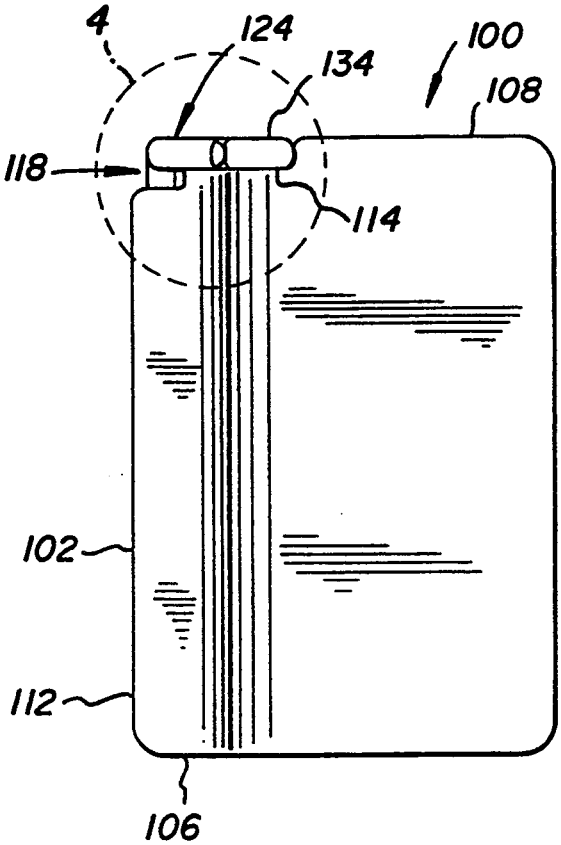
Fig. 1

BEVERAGE CONTAINER

RELATED APPLICATION

This application is a continuation-in-part of U.S. application Ser. No. 07/958,670 filed on Oct. 8, 1992 now U.S. Pat. No. 5,280,844 and also continuation-in-part of U.S. application Ser. No. 07/958,408 filed on Oct. 8, 1992. This application is also a continuation-in-part of U.S. application Ser. No. 07/898,114 filed Jun. 12, 1992 which in turn is a continuation-in-part of U.S. application Ser. No. 07/776,444 filed Oct. 17, 1991, abandoned which applications are hereby incorporation by reference.

FIELD OF THE INVENTION

The present invention relates generally to beverage containers, and more particularly to a one-piece or unitary beverage container with an integral drinking straw or other member.

BACKGROUND OF THE INVENTION

Many different beverages are provided in various containers. Of particular use by small children are small beverage containers which are accessed by a straw. Typically, the straw is removably attached to the outside of the container and is separately wrapped. Thus, the straw can be lost making the beverage hard to consume. In addition, the loose straw and wrapper for the straw are potential problems with small children who might accidentally try to swallow them. These loose items are also a trash nuisance as they tend to be dropped. Further, many of these small beverage containers are made from multi-ply laminates which include paper, foil and plastic and are therefore not easily recyclable.

A beverage container made of a synthetic resin and having a sipping tube or straw connected to the container bottom is disclosed in U.S. Pat. No. 4,982,854 (Ichimiya). A middle portion of the sipping tube is provided with a flexional bellows and the sipping tube is fitted into a longitudinal groove formed on the container body.

Other patents have also disclosed various integral sipping tubes or straws. Among these are the following U.S. Pat. Nos. 4,607,755 (Andreozzi), No. 4,573,631 (Reeves), No. 4,830,204 (Lin), No. 5,054,631 (Robbins), and 5,078,286 (Hashimoto). Other containers of general interest including various straw mounting means are shown in the following U.S. Pat. Nos. 5,005,717 (Oilar), No. 3,332,567 (Pugh, Sr.), No. 4,669,608 (Thompson), and No. 4,712,702 (Ayabe et al.).

SUMMARY OF THE INVENTION

In accordance with a first embodiment of the present invention, a unitary beverage container is provided which includes a main body defining a container volume in which a beverage is contained. The main body includes a bottom, a flat top, and an indentation in the flat top. A bendable conduit has a proximal end which is fluidly connected with the container volume of the main body and a distal end having a drinking aperture therein which when located in an upright position is above the top of the main body. A closing means is used for closing the drinking aperture of the distal end of the bendable conduit and for removably attaching the bendable conduit to the top of the main body. This closing means includes a hollow piece which, together with the adjacent bendable conduit, fills a substantial portion of the indentation when the hollow piece and bendable conduit are in a folded down position. The closing means also includes a connection means for weakly attaching the hollow piece to the top and to the bendable conduit such that the hollow piece and bendable conduit are movable between the folded down position in which the hollow piece and the bendable conduit are contained in the indentation and the upright position where the hollow piece and the bendable conduit extend perpendicularly from the top. A short hollow bridge extends from the distal end of the bendable conduit and about the drinking aperture to the hollow piece. In use, the hollow bridge is broken during pivoting and removal of the hollow piece from the indentation of the top and from the bendable conduit, and thereby the drinking aperture of the bendable conduit is uncovered prior to use.

In this first embodiment of the beverage container, the connection means for the hollow piece includes a solid connection to the top of the container such that the hollow piece is in fluid communication with the container volume only through the bendable conduit. In addition, the main body is generally rectangular shaped in horizontal cross section, and the indentation is provided at one corner of the top.

Preferably, the bendable conduit includes upper and lower rigid portions, and a bendable joint which connects the upper and lower portions. In addition, the indentation is bounded by a lower top wall which is horizontal and flat, and the bendable joint is provided just above a plane containing the lower top wall. Further, the top includes a second indentation in the first-mentioned indentation at the corner adjacent the first-mentioned indentation, and the lower portion of the bendable conduit is fluidly connected to the top at a second lower top wall horizontally bounding the second indentation.

In an alternative configuration of the first embodiment, the bendable conduit includes a tube to which the lower rigid portion is connected and which fluidly connects to the container volume adjacent the bottom of the main body. With this alternative configuration, a corner of the main body adjacent the tube is chamfered to leave a corner space, and the tube is triangular shaped in horizontal cross section and located in the corner space.

In the preferred configuration, the indentation is bounded by a lower top wall which is horizontal and flat, and the hollow piece includes a V shaped edge. Then, the connection means connects the V shaped edge to the lower top wall. In addition, the hollow piece also includes a lateral edge formed at an acute angle to the V shaped edge, and the connection means attaches the lateral edge to the bendable conduit. Further, the lateral edge includes a projection which extends away from the lateral edge at an end of the lateral edge farthest from the V shaped edge, and the hollow bridge extends between the projection and the distal end of the bendable conduit.

It will also be appreciated that, most preferably, the beverage container is integrally made of a blow molded plastics material, and the connection means is a thinly formed connection of the plastics material.

In a second embodiment of the present invention, a unitary beverage container is provided which is similar to the above-described first embodiment. Thus, this embodiment also includes a main body with an indentation and a bendable conduit. But in this second embodiment, the distal end of the bendable conduit is fluidly connected to a hollow mouthpiece which includes a lateral edge and an opposite edge in which a drinking aperture is provided. A short hollow bridge then extends from the hollow mouthpiece and about the drinking aperture. A hollow wing member is attached to the hollow bridge so that the hollow wing member is thus also attached to the hollow mouthpiece. With this design, the wing member and the hollow mouthpiece fill a substantial portion of the indentation when the hollow mouthpiece and wing member are in a folded down position. Finally, a connection means connects the lateral edge of the hollow mouthpiece to the top such that the hollow mouthpiece and hollow wing member are movable between the folded down position in which the hollow mouthpiece and the wing member are contained in the indentation and an upright position where the hollow mouthpiece and the wing member extend perpendicularly from the top. In use, the hollow bridge is broken, after the hollow mouthpiece and the wing member are moved from the folded down position, by twisting of the wing member about the hollow bridge and thereby the drinking aperture of the hollow mouthpiece is uncovered prior to use.

As in the first embodiment, the connection means for the hollow mouthpiece includes a solid connection to the top of the container such that the hollow mouthpiece is in fluid communication with the container volume only through the bendable conduit. Also, the main body is generally rectangular shaped in horizontal cross section, and the indentation is provided at one corner of the top. The beverage container is further integrally made of a blow molded plastics material, and the connection means is a thinly formed connection of the plastics material.

Preferably, the hollow wing member is triangular shaped in horizontal cross section of the wing member in the folded down position. In addition, the bendable conduit includes an upper bellows portion including the distal end which is easily bendable and a lower tube containing the proximal end. The indentation is then bounded by a lower top wall which is horizontal and flat, and the bellows portion is provided at a plane containing the lower top wall. In the preferred configuration, the lower tube is fluidly connected to the container volume adjacent the bottom of the main body. More preferably, a corner of the main body adjacent the lower tube is chamfered to leave a corner space, and the lower tube is triangular shaped in horizontal cross section and located in the corner space.

In one configuration, the indentation is bounded by an inclined top wall which intersects the top, the lateral edge of the hollow mouthpiece piece is angle shaped, and the connection means connects the angle shaped lateral edge to an intersection of the flat top and the inclined top wall. Alternately, the connection means connects the lateral edge to a more extensive inclined wall. With either configuration, the opposite edge of the hollow mouthpiece forms an acute angle with the angle shaped lateral edge. In addition, an intersection of the lateral edge and the opposite edge includes a cutout, and the distal end of the bendable conduit is connected to the hollow mouthpiece at the cutout. Further, an inclination angle of the inclined top wall matches an angle of the angle shaped lateral edge such that in the folded position an uppermost side of the hollow mouthpiece is coplanar with the flat top.

It should also be appreciated that the hollow bridge is preferably connected to the hollow wing member along an adjacent edge thereof and to one side of a longitudinal center of the adjacent edge.

In a third embodiment which is also broadly similar to the first and second mentioned above, the unitary beverage container also includes a main body with an indentation. However, attached to this main body is a drinking tube extending upwardly in the indentation and including a proximal end which is fluidly connected with the container volume of the main body and a distal end having a drinking aperture therein. A closing means for closing the drinking aperture of the distal end of the drinking tube includes a hollow piece located in the indentation, a connection means for weakly attaching the hollow piece to the top, and a short hollow bridge extending from the distal end of the bendable conduit and about the drinking aperture to the hollow piece. Thus, the hollow bridge is broken during pivoting and removal of the hollow piece from the indentation of the top and from the drinking tube, and thereby the drinking aperture of the drinking tube is uncovered prior to use.

As with the other embodiments, the third embodiment of the unitary beverage container is integrally made of plastic and has the connection means for the hollow piece including a solid connection to the top of the container. The main body is also generally rectangular shaped with the indentation provided at one corner of the top.

In a preferred configuration of the third embodiment, the indentation is bounded by (a) a top corner wall which is horizontal and flat and from which the drinking tube extends and (b) an inclined wall extending from the top corner wall to the flat top. With this design, the connection means connects the hollow piece to the inclined wall, the top corner wall, and the drinking tube.

Preferably, the hollow piece includes a V shaped edge, and the connection means connects the V shaped edge to the inclined wall of the indentation. In addition, the hollow piece also includes a lateral edge, and the connection means attaches the lateral edge to the drinking tube. Further, the lateral edge includes a projection which extends away from the lateral edge at an end of the lateral edge farthest from the V shaped edge, and the hollow bridge extends between the projection and the distal end of the bendable conduit.

To effect filling of the beverage container, a filling tube or aperture may be provided which after filling may be crimped, sealed or otherwise closed off. After closure of a filling tube, excess material may be removed and, as shown in the patent to Hashimoto, hereby incorporated by reference, the filling tube may be inverted into the main body of the container in order to provide a surface free of projections. Another filling technique is as shown and described in the above-mentioned Ichimiya patent, hereby incorporated by reference, wherein a flanged filling aperture recessed within the bottom surface is sealed with an adhesive film after filling. Other filling and sealing techniques may be employed as will be apparent to those skilled in the art.

It is an object of the present invention to provide a one-piece beverage container which is easy to make, fill, and use.

It is also an object of the present invention to provide a one-piece beverage container which stands up readily and which is easy to package together with other such beverage containers.

It is a further object of the present invention to provide a beverage container which does not spill easily.

Another object of the present invention is to provide a beverage container and associated parts which are strong and which will not easily develop leaks.

Still another object of the present invention is to provide a hollow mouthpiece which ha a cross-sectional flow area for the beverage which is greater than a cross-sectional flow area of the drinking conduit or straw so that a reservoir is provided in the mouthpiece to help reduce spilling should the beverage container be accidentally tipped over or squeezed.

Other features and advantages of the present invention are stated in or apparent from a detailed description of presently preferred embodiments of the invention found hereinbelow.

BRIEF DESCRIPTION OF THE DRAWINGS

FIG. 1 is an elevation view of a first alternative embodiment of a filled beverage container in a shipping configuration according to the present invention.

FIG. 2 is a left side elevation view of the beverage container depicted in FIG. 1.

FIG. 3 is a top plan view of the beverage container depicted in FIG. 1 and shows that the beverage container is viewed with the main body thereof horizontally rotated to the plane of view for clarity in the elevational views.

FIG. 4 is an enlarged view of the portion of FIG. 1 surrounded by the dashed line 1.

DETAILED DESCRIPTION OF THE PREFERRED EMBODIMENTS

Figure 5:
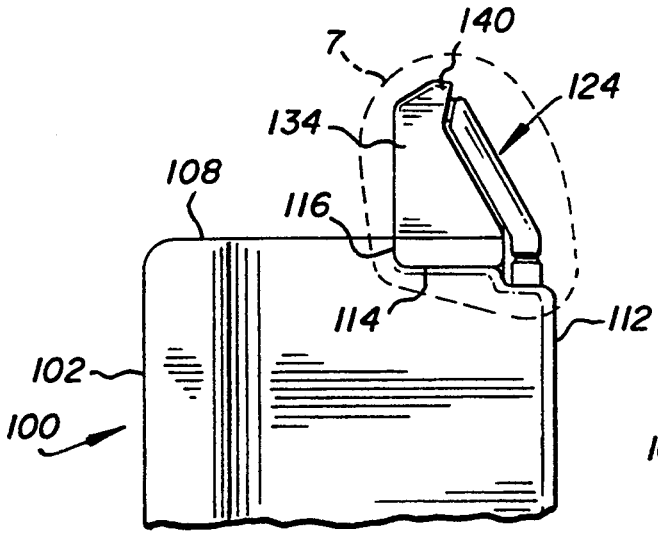
FIG. 5 is an elevation view of a top portion of the beverage container depicted in FIG. 1 in a consuming configuration.

With reference now to the drawings in which like numeral represent like elements throughout the views, a beverage container 100 is depicted in FIGS. 1–8. Beverage container 100 is designed to be blow molded from a synthetic resin or plastic such as low density or high density polyethylene, as a unitary or one-piece container formed in a single operation. Beverage container 100 includes a main body 102 which is rectangularly shaped with rounded corners in plan view and which defines a container volume 104 in which a beverage is contained. Typically, such beverages are fruit juices, flavored drinks or the like. With such beverages, the material of beverage container 100 is usually translucent so that the liquid level can be seen, and the material is colored the same or similar to the color of the beverage contained. In addition, suitable indicia or the like can be provided on the walls of main body 102 as part of the blow molding process if desired. Main body 102 has a top 108 particularly shaped as described subsequently and a bottom 106 which is peripherally flat and somewhat recessed inside of the periphery so that beverage container 100 stands upright easily in normal use.

In use, it will be initially appreciated that beverage container 100 is filled and sold to the consumer or user with a protective wrapping material (shrink wrap, plastic overlay, or the like) thereabout as well known by those of ordinary skill in the art. If desired, a number of beverage containers 100, such as six, can be bound together as a pack by the wrapping material. A cardboard sleeve may be positioned around such a pack inside of the wrapping material.

With reference now to FIGS. 1–9, a beverage container 100 is depicted in both a collapsed (or folded down) form for shipping (FIGS. 1–4) and a consuming (or upright) form for drinking of the beverage therein (FIGS. 5–8). Beverage container 100 includes a main body 102 which is primarily a rectangular box with all edges rounded as shown. Main body 102 defines a container volume 104 and includes a bottom 106, a flat top 108, and an indentation or void 110 in flat top 108. Indentation 110 is formed in one corner 112 of flat top 108 and is bounded by a lower top wall 114 which is generally horizontal and flat and a vertical wall 116 connecting lower top wall 114 to flat top 108. It will also be appreciated that there is a small second indentation 118 provided in indentation 110 at corner 112 similarly bounded by a second lower top wall 120 and a vertical wall 122 extending between second lower top wall 120 and lower top wall 114.

In order to drink the beverage contained in main body 102, beverage container 100 includes a bendable conduit or straw 124. Bendable conduit 124 includes a proximal end 126 which is fluidly connected with container volume 104 through second lower top wall 120 and a distal end 128 having a drinking aperture 130 therein. Conduit 124 could be extended, either internally or externally of the main body 102, to fluidly connect with the container volume 104 adjacent the bottom of said main body.

Figure 6:
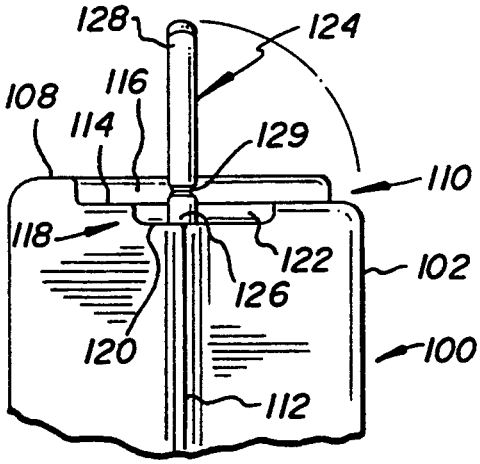
FIG. 6 is a left side elevation view of the beverage container depicted in FIG. 5.
Figure 7:
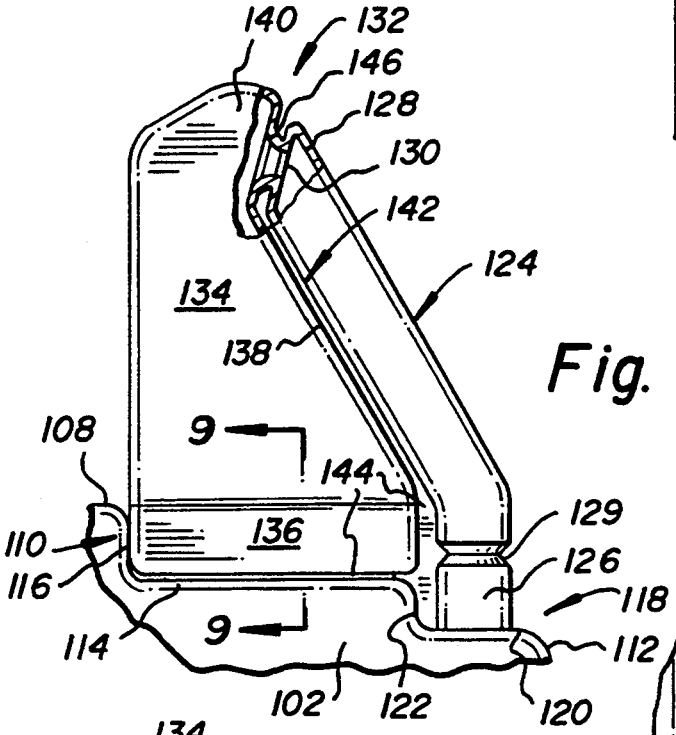
FIG. 7 is an enlarged view of the portion of FIG. 5 surrounded by the dashed line 7 with a portion cut away.

As shown in FIGS. 5–7, in an upright position suitable for drinking, distal end 128 of bendable conduit 124 is located well above flat top 108. In this preferred embodiment, proximal end 126 forms a lower rigid portion and distal end 128 forms an upper rigid portion so that bendable conduit 124 is bendable by provision of a bendable joint 129 between ends 126 and 128 in addition to the natural resiliency of the material from which bendable conduit 124 is formed. Bendable joint 129 is located at a position just above lower top wall 114. It will be appreciated that bendable conduit 124 could take other forms such as a segmented straw.

In order to close drinking aperture 130 and additionally to removably attach bendable conduit 124 to flat lower top wall 114 of top 108, a closing means 132 is provided. Closing means 132 includes a hollow piece 134 which together with bendable conduit 124 fill a substantial portion of indentation 110 when hollow piece 134 and bendable conduit 124 are in a folded down position as shown in FIGS. 1–4. It will be appreciated that in this folded down position, beverage container 100 is suitable for compact packaging, shipping, and storage. Hollow piece 134 includes a V shaped edge 136 as shown best in FIG. 9 and a lateral edge 138 formed at an acute angle of about 60° to V shaped edge 136. At the end of lateral edge 138 farthest from V shaped edge 136, a tip or projection 140 is formed.

Figure 9:
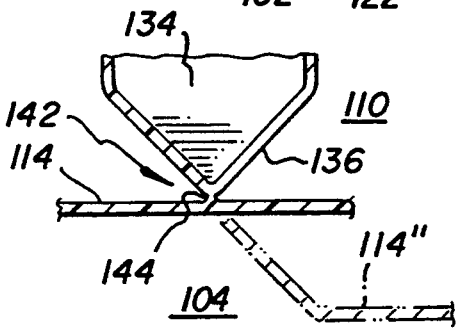
FIG. 9 is a cross-sectional view of the top of the beverage container taken along the section line 9—9 in FIG. 7.
Figure 8:
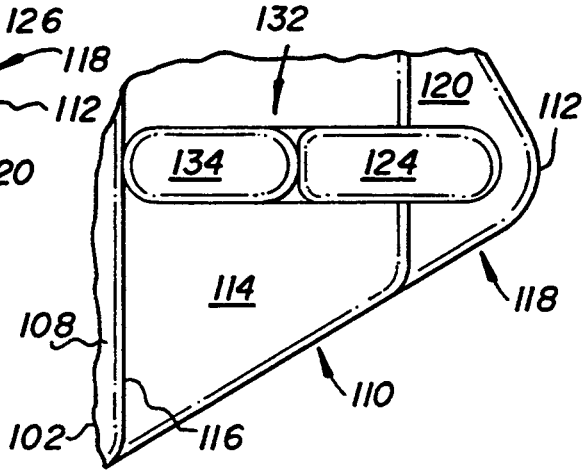
FIG. 8 is an enlarged top view of a relevant portion of the top of the beverage container depicted in FIG. 5.
Figure 10:
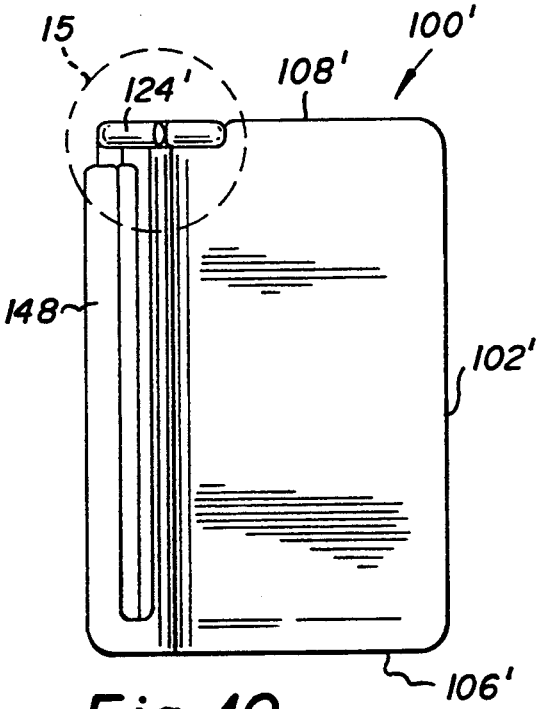
FIG. 10 is an elevation view of an alternative configuration of the filled beverage container depicted in FIG. 1 in a shipping configuration according to the present invention.
Figure 11:
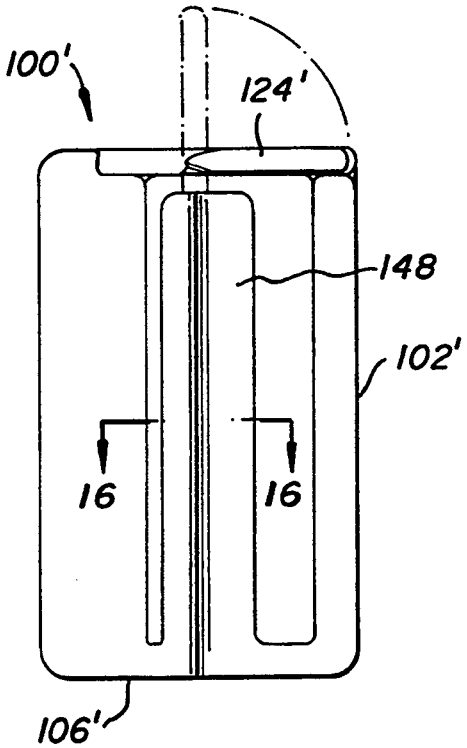
FIG. 11 is a left side elevation view of the beverage container depicted in FIG. 10.
Figure 12:
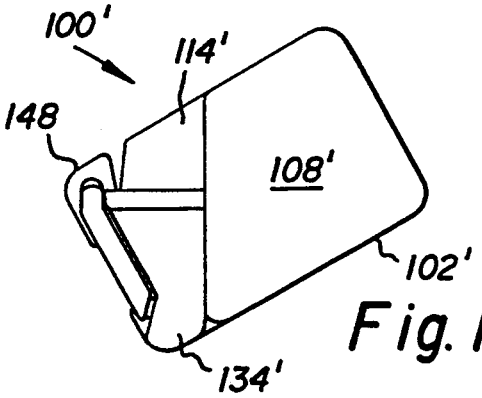
FIG. 12 is a top plan view of the beverage container depicted in FIG. 10 and shows that the beverage container is viewed with the main body thereof horizontally rotated to the plane of view for clarity in the elevational views.
Figure 13:
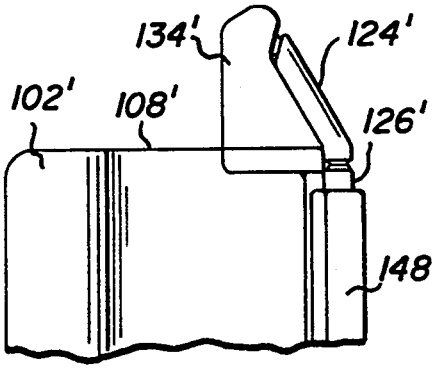
FIG. 13 is an elevation view of a top portion of the beverage container depicted in FIG. 10 in a consuming configuration.
Figure 15:
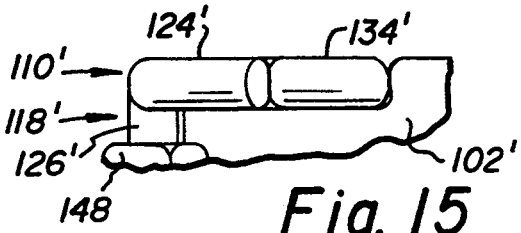
FIG. 15 is an enlarged view of the portion of FIG. 10 surrounded by the dashed line 30.
Figure 16:
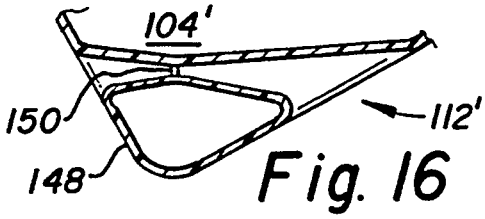
FIG. 16 is a cross-sectional view of the top of the beverage container taken along the section line 16—16 in FIG. 11.
Figure 14:
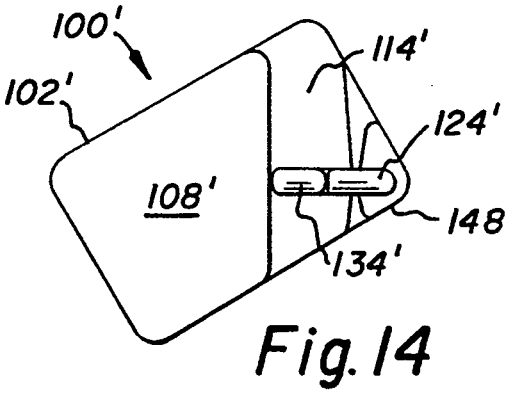
FIG. 14 is a top plan view of the beverage container depicted in FIG. 13.

Closing means 132 also includes a connection means 142 which weakly attaches hollow piece 134 to flat top 114 and to bendable conduit 124. Preferably, connection means 142 is a thinly formed but solid connection 144 provided between hollow piece 134 and flat lower top wall 114 and bendable conduit 124. Solid connection 144 is best shown in FIG. 9 where V shaped edge 136 is connected to lower top wall 114 and at this location solid connection 144 also forms a pivoting connection. In addition, solid connection 144 is also shown in FIG. 7 as the filled in area between hollow piece 134 and bendable conduit 124. Solid connection 144 is simply formed during the blow molding process from the plastic material which is allowed to remain, but it will be appreciated that the remaining material is quite thin and thus is easily broken so that these parts are only weakly connected together. With connection means 142, hollow piece 134 and bendable conduit 124 are located in indentation 110 in the folded down position, and hollow piece 134 and bendable conduit 124 are movable from this folded down position by pivoting movement about solid connection 144 connecting V shaped edge 136 to lower top wall 114 to an upright position extending perpendicular (or further if desired) from flat top 108 as shown in FIGS. 5–9.

Closing means 132 further includes a short hollow bridge 146 (best shown in FIG. 7) which extends from distal end 128 of bendable conduit 124 and about drinking aperture 130 to projection 140 of hollow piece 134. With this configuration of hollow bridge 146 and solid connection 142, it will be appreciated that although hollow piece 134 is hollow the only fluid connection between hollow piece 134 and container volume 104 is through bendable conduit 124.

In use, beverage container 100 is used in the following manner. Initially, beverage container 100 is formed as described above and filled in any known manner. As part of the packaging process for distribution, hollow piece 134 and connected bendable conduit 124 are pressed down into the folded position as shown in FIGS. 1–4 where hollow piece 134 and bendable conduit 124 are held in place as by a surrounding wrapper or the like. In this folded down position, beverage container 100 forms essentially a rectangular box, as hollow piece 134 and bendable conduit 124 fill most of indentation 110 as shown best in FIG. 18.

When the consumer wishes to consume the beverage contained in main body 102, the wrapper is removed and hollow piece 134 and bendable conduit 124 are lifted from the folded position. As this occurs (or if preferred, after hollow piece 134 and bendable conduit 124 are more or less vertical), hollow piece 134 is grasped and pulled away from bendable conduit 124. As connection means 142 is formed only of relatively weak solid connection 144, solid connection 144 is easily broken by this movement. Then, by continuing this movement, hollow bridge 144 is similarly broken to uncover drinking aperture 130. The consumer can then easily drink the beverage by sucking on bendable conduit 124 which can be directed at most any desirable orientation due to the bending action of bendable joint 129 and the material of bendable conduit 124.

While beverage container 100 is depicted with lower top wall 114 of indentation 110 being straight from one side of main body 102 to the other, in another preferred embodiment an alternative configuration is provided. In particular, lower top wall 114 to the left (as depicted in FIG. 9) of hollow piece 134 is provided at or just above the height of bendable joint 129, while the remainder of lower top wall to the right is replaced with a lower top wall 114'' as shown in dashed lines in FIG. 9. Thus, as shown in FIG. 9, solid connection 144 would be provided at the junction of the left portion of lower top wall 114 and the portion angling down to lower top wall 114''. Lower top wall 114'' thus provides the recess in which hollow piece 134 is received and there is less of a depression remaining to the left of hollow piece 134 when hollow piece 134 and bendable conduit 124 are in the folded down position.

Depicted in FIGS. 10–16 is a beverage container 100' which is an alternative configuration of beverage container 100, and which is shown in similar views. In this configuration of beverage container 100', the same identifying numerals are used as with beverage container 100, but with the addition of a prime (') for the same elements which are not discussed further. It will also be appreciated that beverage container 100' is used in virtually the same manner as beverage container 100 so that the use of beverage container 100' and in particular bendable conduit 124' and hollow piece 134' will not be described further.

With beverage container 100', corner 112' is chamfered along the vertical length thereof beginning adjacent bottom 106' leaving a corner space. Then upstanding from the portion of corner 112' remaining adjacent bottom 106' is a tube 148 which is fluidly connected to container volume 104'. Tube 148 is broadly triangularly shaped in horizontal cross section as shown to substantially fill the corner space left from the chamfering of corner 112'. In addition, it will also be appreciated that tube 148 may be connected along the vertical length of corner 112' by thin wall 150 formed similar to solid connection 144.

Tube 148 is hollow as shown, and the top thereof forms the location of second indentation 118'. At second indentation 118', proximal end 126' of bendable conduit 124' is fluidly connected to tube 148 so that bendable conduit 124' is able to serve as a drinking straw or conduit for the liquid in beverage container 100'. It will be appreciated that the top of tube 148 also serves as an air reservoir after each sip is made through bendable conduit 124', so that there is less chance for expelling liquid through bendable conduit 124' if beverage bottle is squeezed.

With reference now to FIGS. 17–25, a second embodiment of a beverage container 200 is depicted in both a collapsed or folded down form (FIGS. 17–19) and a consuming or upright form (FIGS. 20–24). Beverage container 200 is broadly similar in many respects to beverage container 100 so that similar elements will be discussed only briefly. Thus, beverage container 200 includes a main box-shaped body 202, a container volume 204, a bottom 206, a flat top 208, and an indentation 210. However, in this embodiment, it will be appreciated that indentation 210 is located in a corner 212 so as to extend diagonally between the two adjacent corners **212*a* and 212*b*. Indentation 210 is bounded by a lower top wall 214 and an inclined vertical wall 216 extending horizontally as well as vertically (as opposed to vertical wall 116** discussed previously).

Corner **212*a* of beverage container 200 is chamfered in a similar manner to that of corner 112' discussed above with respect to beverage container 100'. This leaves a corner space above the portion of corner 212*a* adjacent bottom 206 which is not chamfered, and a bendable conduit 218 is provided in this corner space. Bendable conduit 218 includes a proximal end 220 which is fluidly connected to container volume 204 and a distal end 222**.

Connected to distal end 222 of bendable conduit 218 by a bendable joint 223 is a hollow mouthpiece 224. Hollow mouthpiece 224 includes a lateral edge 226 and an opposite edge 228 in which a drinking aperture 230 is provided as this hollow volume acts as a reservoir. In particular, it will be appreciated that mouthpiece 224 has a cross-sectional flow area (the cross-sectional area perpendicular to the direction of direct flow of the beverage from bendable conduit or straw 218 to aperture 230) for the beverage which is greater than a cross-sectional flow area of bendable conduit 218. In other words, the volume of mouthpiece 224 for the flow length between bendable conduit 218 and aperture 230 is greater than a volume of bendable conduit 218 for the same length of flow so that the reservoir is thus formed and provided in mouthpiece 230.

In order to close drinking aperture 230, a short hollow bridge 232 extends from opposite edge 228 and about drinking aperture 230. Then, attached to hollow bridge 232 is a hollow wing member 234. It will be appreciated that hollow bridge 232 is similar to the hollow bridge 146 discussed above, so that when wing member 234 is twisted about hollow bridge 232 and a thin connecting wall 235 is broken, hollow bridge 232 breaks and wing member 234 is separated from hollow mouthpiece 224 and is thrown away. The breaking of bridge 232 exposes drinking aperture 230 for use as described subsequently.

It will also be appreciated that drinking aperture 230 is located near the upper end opposite edge 228 for easy access by the user, and thus hollow bridge 232 is connected to hollow wing member 234 along opposite edge 228 and to one side of a longitudinal center of opposite edge 228.

Figure 17:
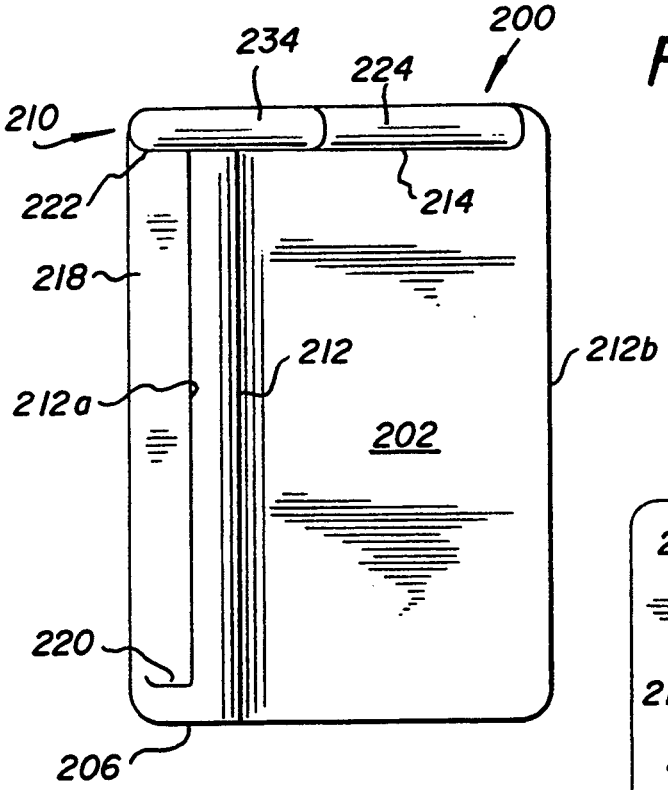
FIG. 17 is an elevation view of a second embodiment of a filled beverage container in a shipping configuration according to the present invention.
Figure 18:
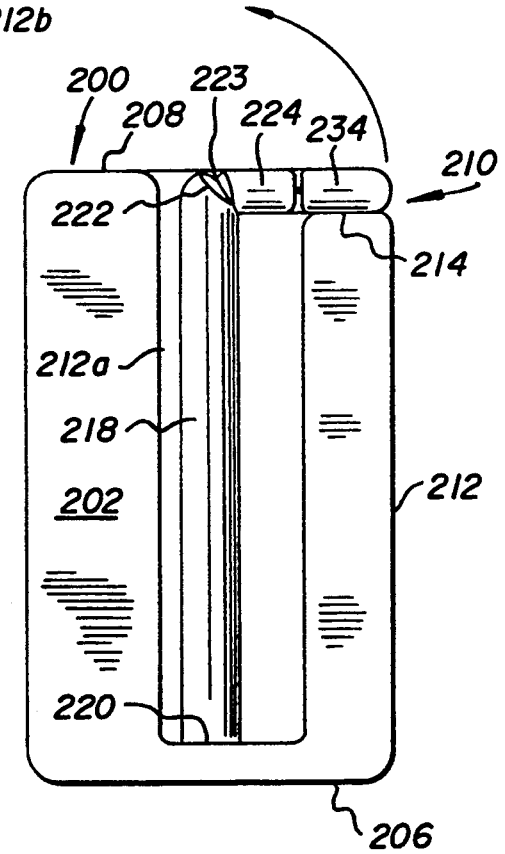
FIG. 18 is a left side elevation view of the beverage container depicted in FIG. 17.
Figure 19:
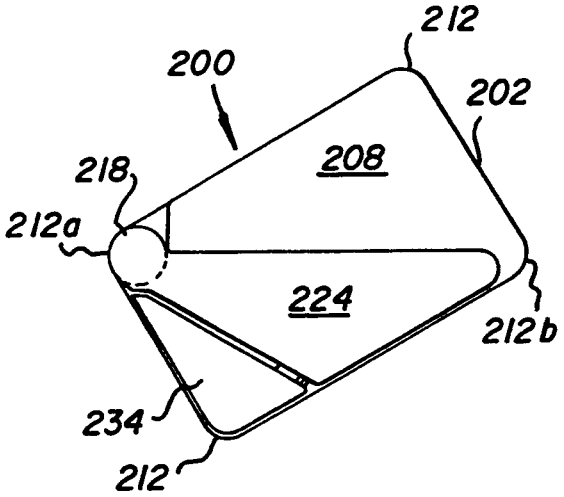
FIG. 19 is a top plan view of the beverage container depicted in FIG. 17 and shows that the beverage container is viewed with the main body thereof horizontally rotated to the plane of view for clarity in the elevational views.

It will be noted that hollow wing member 234 is triangular shaped, and together with hollow mouthpiece 224 forms a member also of basic triangular shape which fits in indentation 210 when mouthpiece 224 is in the folded down position as shown in FIGS. 17–19. This is achieved by forming indentation 210 in a manner similar to indentation 110 of beverage container 100 discussed above so that indentation 210 includes lower top wall 214 forming a plane at the location of bendable joint 223. Further, corner **212*a* is also chamfered along the vertical length thereof to receive circular shaped bendable conduit 218** in a corner space provided by the chamfering.

Connecting lateral edge 226 of hollow mouthpiece 224 to top 108 is a connection means 236. Connection means 236 is preferably a solid connection 238 formed during the molding process so that hollow mouthpiece 224 is in fluid communication with container volume 204 only through bendable conduit 218. With connection means 236, hollow mouthpiece 224 and hollow wing member 234 are movable between (a) a folded down position as shown in FIGS. 17–19 in which hollow mouthpiece 224 and hollow wing member 234 are contained in indentation 210 and (b) an upright position as shown in FIGS. 35–38 where hollow mouthpiece 224 and wing member 234 extend perpendicularly from top 208.

Figure 24:
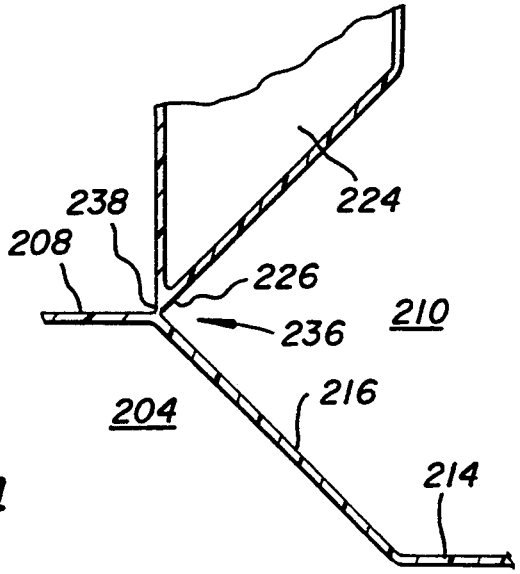
FIG. 24 is a cross-sectional view of a portion of the top of the beverage container taken along the section line 24—24 in FIG. 23.
Figure 20:
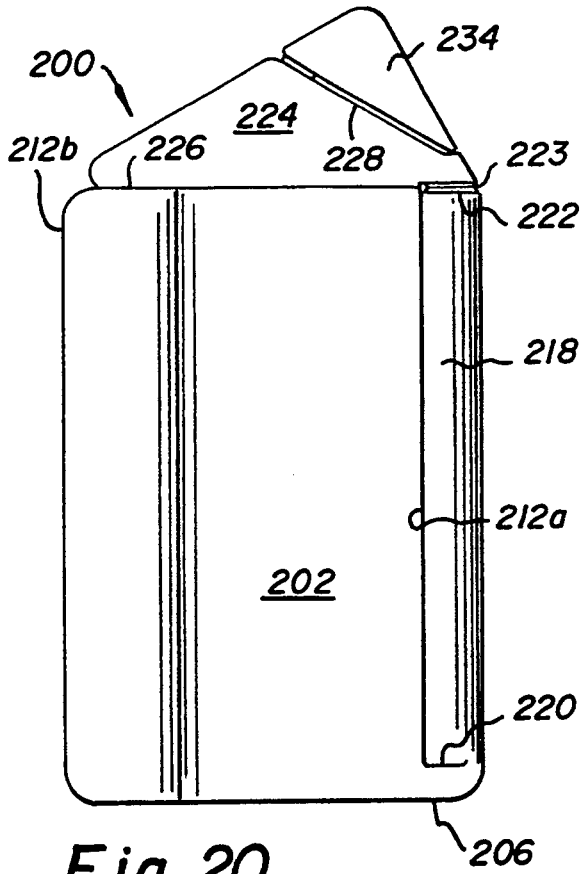
FIG. 20 is an elevation view from a reverse side of a top portion of the beverage container depicted in FIG. 17 in a consuming configuration.
Figure 21:
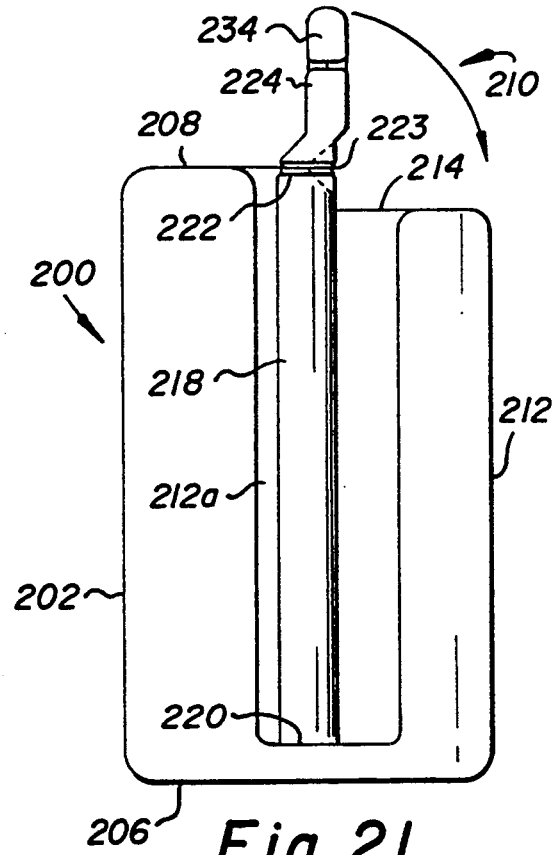
FIG. 21 is a left side elevation view of the beverage container depicted (in reverse) in FIG. 20.
Figure 22:
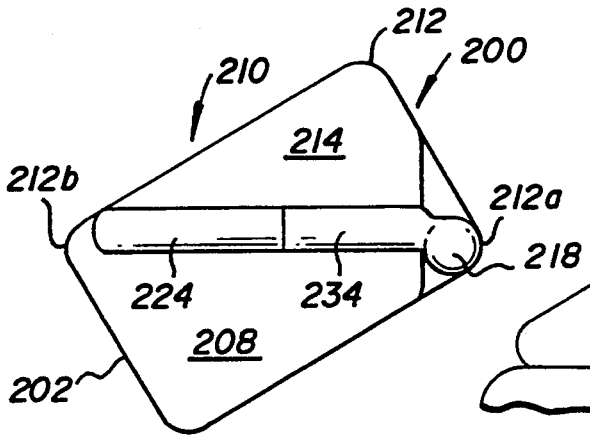
FIG. 22 is a top plan view of the beverage container depicted in FIG. 20.

As best shown in FIG. 24, indentation 210 is preferably bounded by inclined wall 216 which intersects with top 208. Also, it will be noted that lateral edge 226 of hollow mouthpiece is angle shaped and has an inside angle which matches an inclination angle of inclined wall 216. Then, connection means 236 connects this angle shaped lateral edge 226 to the intersection of flat top 208 and inclined wall 216. This allows hollow mouthpiece 224 and hollow wing member 234 to easily be folded down in indentation 210.

Figure 23:
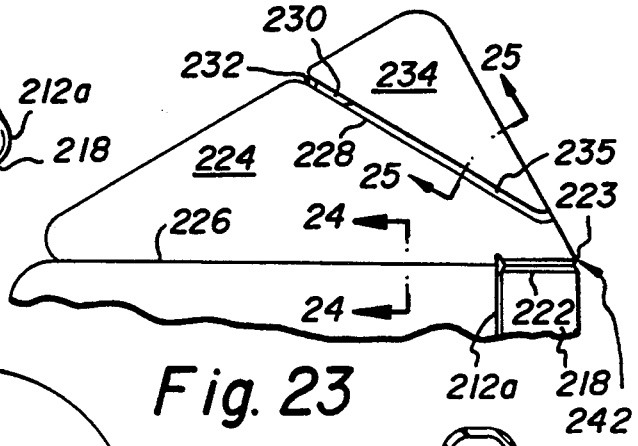
FIG. 23 is an enlarged view of the top portion of FIG. 20.

As shown in best in FIG. 23, opposite edge 228 of hollow mouthpiece 224 preferably forms an acute angle with lateral edge 226. At the intersection of edges 226 and 228, there is then formed a slight cutout 242 where distal end 222 of bendable conduit 218 is connected to hollow mouthpiece 224. In this preferred embodiment, it will also be noted that bendable joint 223 is also formed at cutout 242.

Figure 26:
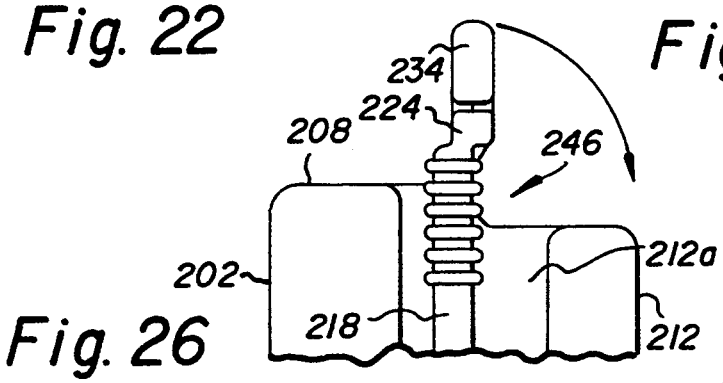
FIG. 26 is a left side elevation view of an alternative configuration of the beverage container depicted in FIG. 21 with a bellows portion.
Figure 25:
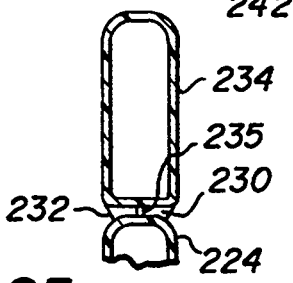
FIG. 25 is a cross-sectional view of a portion of the top of the beverage container taken along the section line 25—25 in FIG. 23.
Figure 27:
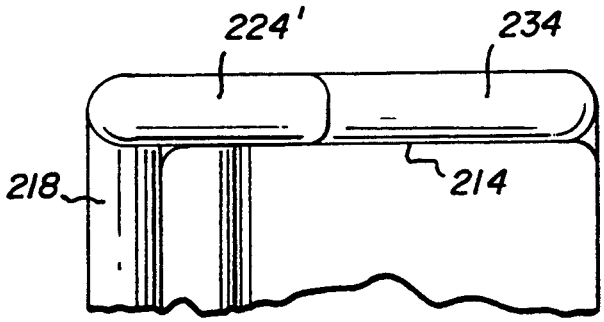
FIG. 27 is an elevation view of a top portion of an alternative configuration of the filled beverage container as shown in FIG. 17 in a shipping configuration.
Figure 28:
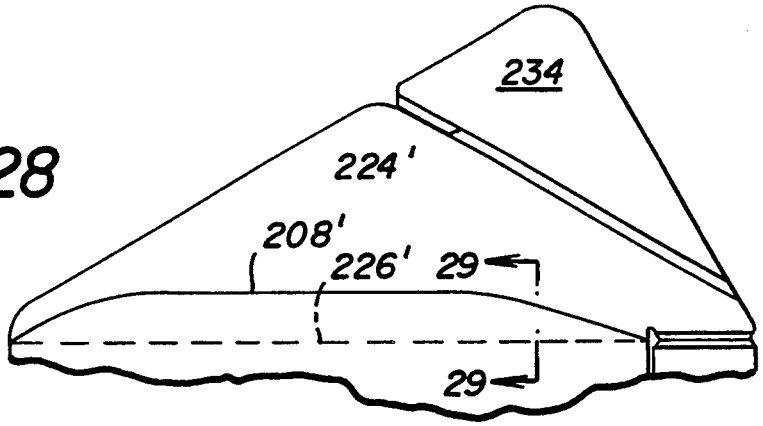
FIG. 28 is an enlarged elevation view of the top portion of FIG. 27 in a consuming configuration.
Figure 29:
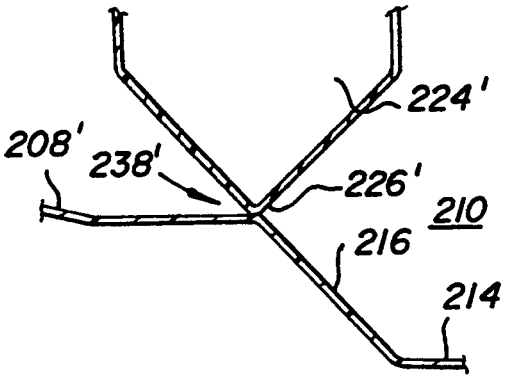
FIG. 29 is a cross-sectional view of a portion of the top of the beverage container taken along the section line 29—29 in FIG. 28.
Figure 30:
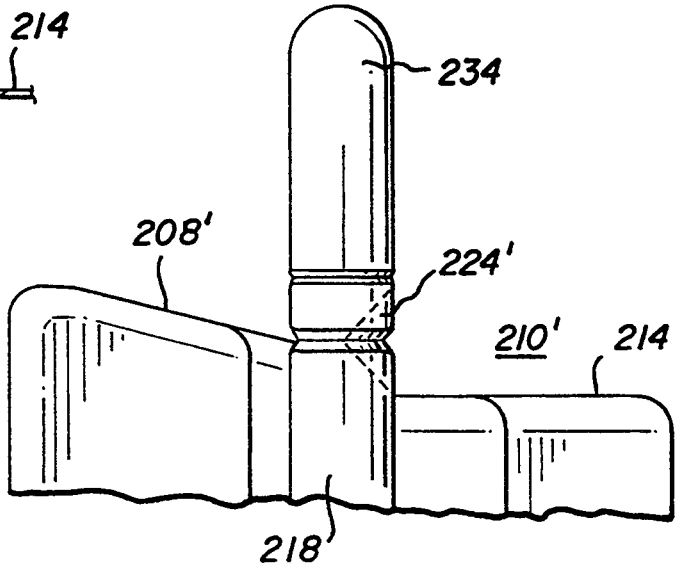
FIG. 30 is an enlarged left side elevation view of the beverage container depicted in FIG. 28.
Figure 31:
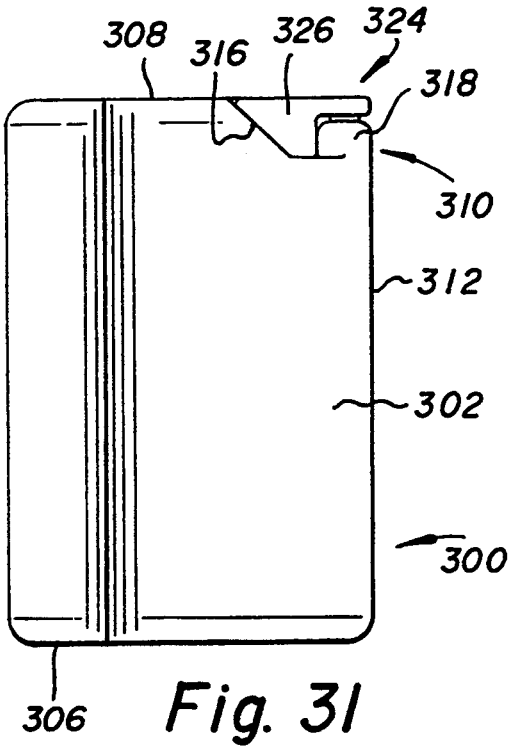
FIG. 31 is an elevation view of a third embodiment of a filled beverage container in a shipping configuration according to the present invention.
Figure 32:
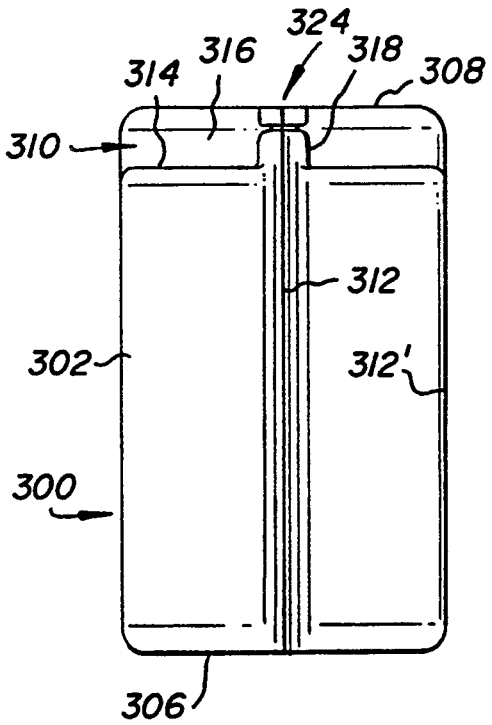
FIG. 32 is a right side elevation view of the beverage container depicted in FIG. 31.
Figure 33:
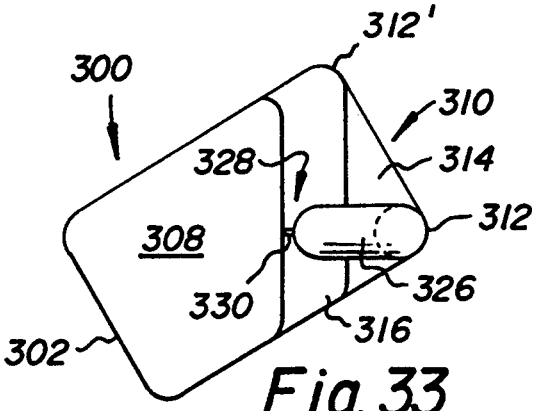
FIG. 33 is a top plan view of the beverage container depicted in FIG. 31 and shows that the beverage container is viewed with the main body thereof horizontally rotated to the plane of view for clarity in the elevation views.

Depicted in FIG. 26 is an alternative configuration of beverage container 200. In this configuration, it will be appreciated that bendable joint 218 is replaced with an upper bellows portion 246. This configuration makes it easier to bend bendable conduit 218 as well as hollow mouthpiece 224 and hollow wing member 234 into and out of indentation 210.

Depicted in FIGS. 27–30 is a second alternative configuration of beverage container 200. In this configuration, flat top 208' is somewhat inclined, rather than flat as with flat top 208. In addition, lateral edge 226' of hollow mouthpiece 224' is V shaped rather than generally angle shaped as with lateral edge 226. The inclination angle of inclined wall 216 matches that of lateral edge 226' as with the other configuration noted above so that hollow mouthpiece 224' and hollow wing member 234' fit flat in indentation 210. However, it will also be noted that flat top 208' is not horizontal, but instead is slightly inclined for a different and more aesthetic appearance as well as increased ease in molding of bendable conduit 218.

With reference now to FIGS. 31–35, a third embodiment of a beverage container 300 is depicted which does not collapse but simply has a removable member. Beverage container 300 is broadly similar in many respects to beverage containers 100 and 200 so that similar elements will be discussed only briefly. Thus, beverage container 300 includes a main box-shaped body 302, a container volume 304, a bottom 306, a flat top 308, and an indentation 310. However, in this embodiment, it will be appreciated that indentation 310 is located in a corner 312 so as to extend diagonally to an adjacent corner 312'. Indentation 310 is bounded by a top corner wall 314 which is horizontal and flat and an inclined wall 316 which is inclined as shown between lower top wall 314 and flat top 308.

Extending upwards from lower top wall 314 in indentation 310 is a very short drinking tube 318. Drinking tube 318 includes a proximal end 320 which is fluidly connected to container volume 304 and a distal end 322 having a drinking aperture therein. It should be appreciated that drinking tube 318 could be extended to communicate with the bottom of container 300 as is the case with containers 100' and 200.

In order to close the drinking aperture in distal end 322 of drinking tube 318, a closing means 324 is provided. Closing means 324 includes a hollow piece 326 in indentation 310 and a connection means 328 for weakly attaching hollow piece 326 to drinking tube 318, inclined wall 316 and top corner wall 314. Preferably, as with the other embodiments and to isolate hollow piece 326 from container volume 304, connection means 328 is a thin solid connection 330 created during the forming process.

A short hollow bridge 332 extends from distal end 322 of drinking tube 318 and about the drinking aperture therein to hollow piece 326. As with the other embodiments as well, hollow bridge 332 is broken during pivoting and removal of hollow piece 326 from indentation 310 and hence from drinking tube 318. Thus, by removal of hollow piece 326, the drinking aperture of drinking tube 318 is uncovered for the user to use to consume the beverage in beverage container 300.

Figure 36:
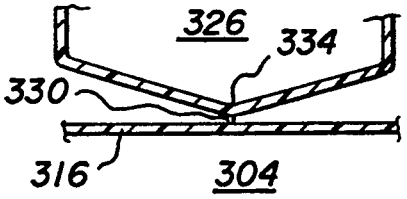
FIG. 36 is a cross-sectional view of a portion of the top of the beverage container taken along the section line 36—36 in FIG. 34.
Figure 35:
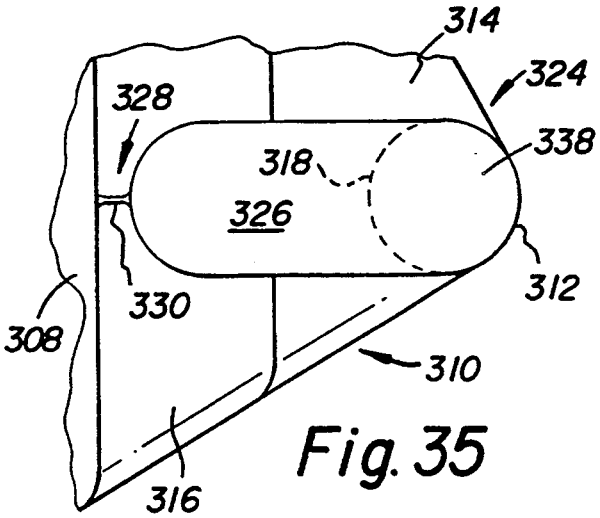
FIG. 35 is an enlarged top plan view of the relevant top portion of the beverage container depicted in FIG. 32.
Figure 34:
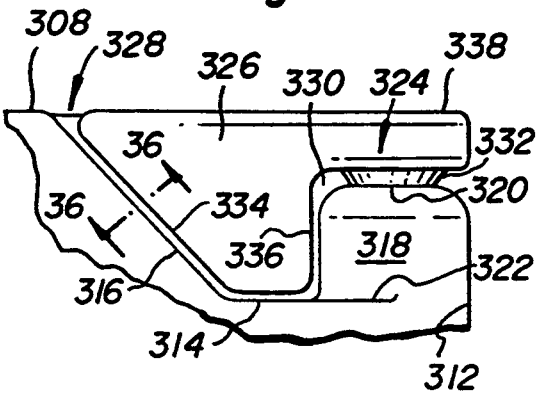
FIG. 34 is an enlarged elevation view of the top portion of the beverage container depicted in FIG. 31.

As shown in FIGS. 34 and 36, hollow piece 326 includes a wide V shaped edge 334 which is connected to inclined wall 316 by solid connection 330 and a lateral edge 336 which is attached by solid connection 330 to drinking tube 318. Lateral edge 336 preferably includes a projection 338 which extends away therefrom at the end of lateral edge 336 which is farthest from V shaped edge 334. Hollow bridge 332 thus extends between projection 338 and distal end 322 of drinking tube 318.

While the present invention has been described with respect to exemplary embodiments thereof, it will be understood by those of ordinary skill in the art that variations and modifications can be effected within the scope and spirit of the invention. In particular, features of one embodiment can be incorporated in other embodiments as appropriate or desired.

What is claimed is:

1. A unitary beverage container comprising:

a main body defining a container volume in which a beverage is contained, said main body including a bottom, a flat top, and an indentation in said flat top;

a bendable conduit having a proximal end which is fluidly connected with the container volume of said main body and a distal end having a drinking aperture therein; and a closing means for closing said drinking aperture of said distal end of said bendable conduit and for removably attaching said bendable conduit to said top of said main body, said closing means including a hollow piece which, together with and adjacent said bendable conduit, fills a substantial portion of said indentation when said hollow piece and bendable conduit are in a folded down position, a connection means for weakly attaching said hollow piece to said top and to said bendable conduit such that said hollow piece and bendable conduit are movable between the folded down position in which said hollow piece and said bendable conduit are contained in said indentation and the upright position where said hollow piece and said bendable conduit extend perpendicularly from said top, and a short hollow bridge extending from said distal end of said bendable conduit and about said drinking aperture to said hollow piece;

whereby said hollow bridge is broken during pivoting and removal of said hollow piece from said indentation of said top and from said bendable conduit, and thereby said drinking aperture of said bendable conduit is uncovered prior to use.

2. A beverage container as claimed in claim 1 wherein said connection means for said hollow piece includes a solid connection to said top of said container such that said hollow piece is in fluid communication with said container volume only through said bendable conduit.

3. A beverage container as claimed in claim 1 wherein said main body is generally rectangular shaped in horizontal cross section, and said indentation is provided at one corner of said top.

4. A beverage container as claimed in claim 3 wherein said bendable conduit includes upper and lower rigid portions, and a bendable joint which connects said upper and lower portions.

5. A beverage container as claimed in claim 4 wherein said indentation is bounded by a lower top wall which is horizontal and flat, and said bendable joint is provided at a position just above said lower top wall.

6. A beverage container as claimed in claim 5 wherein said top further includes a second indentation in said first-mentioned indentation at the corner adjacent said first-mentioned indentation, and wherein said lower portion of said bendable conduit is fluidly connected to said top at a second lower top wall horizontally bounding said second indentation.

7. A beverage container as claimed in claim 4 wherein said bendable conduit further includes a tube to which said lower rigid portion is connected and which fluidly connects to said container volume adjacent said bottom of said main body.

8. A beverage container as claimed in claim 7 wherein a corner of said main body adjacent said tube is chamfered to leave a corner space, and wherein said tube is triangular shaped in horizontal cross section and located in the corner space.

9. A beverage container as claimed in claim 2 wherein said indentation is bounded by a lower top wall which is horizontal and flat, wherein said hollow piece includes a V shaped edge, and wherein said connection means connects said V shaped edge to said lower top wall.

10. A beverage container as claimed in claim 9 wherein said hollow piece also includes a lateral edge formed at an acute angle to said V shaped edge, and said connection means attaches said lateral edge to said bendable conduit.

11. A beverage container as claimed in claim 10 wherein said lateral edge includes a projection which extends away from said lateral edge at an end of said lateral edge farthest from said V shaped edge, and wherein said hollow bridge extends between said projection and said distal end of said bendable conduit.

12. A beverage container as claimed in claim 1 wherein said beverage container is integrally made of a blow molded plastics material, and wherein said connection means is a thinly formed connection of said plastics material.

13. A unitary beverage container comprising:

a main body defining a container volume in which a beverage is contained, said main body including a bottom, a flat top, and an indentation in said flat top;

a bendable conduit having a proximal end which is fluidly connected with the container volume of said main body and a distal end;

a hollow mouthpiece to which said distal end of said bendable conduit is fluidly connected, said hollow mouthpiece including a lateral edge and an opposite edge in which a drinking aperture is provided;

a short hollow bridge extending from said hollow mouthpiece and about said drinking aperture;

a hollow wing member which is attached to said hollow bridge, said hollow wing member thus being attached to said hollow mouthpiece such that said wing member and said hollow mouthpiece fill a substantial portion of said indentation when said hollow mouthpiece piece and wing member are in a folded down position; and a connection means for connecting said lateral edge of said hollow mouthpiece to said top such that said hollow mouthpiece and hollow wing member are movable between the folded down position in which said hollow mouthpiece and said wing member are contained in said indentation and an upright position where said hollow mouthpiece and said wing member extend perpendicularly from said top;

whereby said hollow bridge is broken, after said hollow mouthpiece and said wing member are moved from the folded down position, by twisting of said wing member about said hollow bridge and thereby said drinking aperture of said hollow mouthpiece is uncovered prior to use.

14. A beverage container as claimed in claim 13 wherein said connection means for said hollow mouthpiece includes a solid connection to said top of said container such that said hollow mouthpiece is in fluid communication with said container volume only through said bendable conduit.

15. A beverage container as claimed in claim 13 wherein said main body is generally rectangular shaped in horizontal cross section, and said indentation is provided at one corner of said top.

16. A beverage container as claimed in claim 15 wherein said hollow wing member is triangular shaped in horizontal cross section of said wing member in the folded down position.

17. A beverage container as claimed in claim 15 and further including a bendable joint between said distal end of said bendable conduit and said hollow mouthpiece.

18. A beverage container as claimed in claim 17 wherein said indentation is bounded by a lower top wall which is horizontal and flat, and said bendable joint is provided at a plane containing said lower top wall.

19. A beverage container as claimed in claim 17 wherein said bendable conduit is fluidly connected to said container volume adjacent said bottom of said main body.

20. A beverage container as claimed in claim 19 wherein a corner of said main body adjacent said bendable conduit is chamfered to leave a corner space, and wherein said bendable conduit is circular shaped in horizontal cross section and located in the corner space.

21. A beverage container as claimed in claim 14 wherein said indentation is bounded by an inclined top wall which intersects said top, wherein said lateral edge of said hollow mouthpiece is angle shaped, and wherein said connection means connects said angle shaped lateral edge to an intersection of said flat top and said inclined top wall.

22. A beverage container as claimed in claim 21 wherein said opposite edge of said hollow mouthpiece forms an acute angle with said angle shaped lateral edge.

23. A beverage container as claimed in claim 22 wherein an intersection of said lateral edge and said opposite edge includes a cutout, and wherein said distal end of said bendable conduit is connected to said hollow mouthpiece at said cutout.

24. A beverage container as claimed in claim 21 wherein an inclination angle of said inclined top wall matches an angle of said angle shaped lateral edge such that in the folded position an uppermost side of said hollow mouthpiece is coplanar with said flat top.

25. A beverage container as claimed in claim 15 wherein said bendable conduit includes an upper bellows portion including said distal end which is easily bendable and a lower tube containing said proximal end.

26. A beverage container as claimed in claim 25 wherein said indentation is bounded by a lower top wall which is horizontal and flat, and said bellows portion is provided at a plane containing said lower top wall.

27. A beverage container as claimed in claim 25 wherein said lower tube is fluidly connected to said container volume adjacent said bottom of said main body.

28. A beverage container as claimed in claim 14 wherein said indentation is bounded by an inclined top wall which intersects said top, wherein said lateral edge of said hollow mouthpiece is angle shaped, and wherein said connection means connects said angle shaped lateral edge to said inclined top wall.

29. A beverage container as claimed in claim 28 wherein said opposite edge of said hollow mouthpiece forms an acute angle with said angle shaped lateral edge.

30. A beverage container as claimed in claim 29 wherein an intersection of said lateral edge and said opposite edge includes a cutout, and wherein said distal end of said bendable conduit is connected to said hollow mouthpiece at said cutout.

31. A beverage container as claimed in claim 28 wherein an inclination angle of said inclined top wall matches an angle of said angle shaped lateral edge such that in the folded position an uppermost side of said hollow mouthpiece is coplanar with said flat top.

32. A beverage container as claimed in claim 13 wherein said hollow mouthpiece has a cross-sectional flow area for the beverage which is greater than a cross-sectional flow area of said distal end of said bendable conduit so that a reservoir is provided in said hollow mouthpiece.

33. A beverage container as claimed in claim 13 wherein said beverage container is integrally made of a blow molded plastics material, and wherein said connection means is a thinly formed connection of said plastics material.

* * * * *